US008056349B2

(12) United States Patent
Oswald

(10) Patent No.: US 8,056,349 B2
(45) Date of Patent: Nov. 15, 2011

(54) METHOD AND APPARATUS FOR MAINTAINING A UNIFORM TEMPERATURE IN A REFRIGERATION SYSTEM

(75) Inventor: Ian Oswald, Santa Ana, CA (US)

(73) Assignee: B/E Aerospace, Inc., Wellington, FL (US)

( * ) Notice: Subject to any disclaimer, the term of this patent is extended or adjusted under 35 U.S.C. 154(b) by 259 days.

(21) Appl. No.: 11/891,692

(22) Filed: Aug. 13, 2007

(65) Prior Publication Data

US 2009/0044547 A1 Feb. 19, 2009

(51) Int. Cl.

| | |
|---|---|
| ***F25D 17/04*** | (2006.01) |
| ***F25D 17/06*** | (2006.01) |
| ***F25D 11/00*** | (2006.01) |
| ***A47F 3/04*** | (2006.01) |

(52) U.S. Cl. ..... 62/186; 62/89; 62/187; 62/255; 62/408; 62/440

(58) Field of Classification Search ..... 62/407, 62/408, 248, 239, 255, 89, 179, 187
See application file for complete search history.

(56) References Cited

U.S. PATENT DOCUMENTS

| | | | | |
|---|---|---|---|---|
| 2,896,425 | A * | 7/1959 | Dunbar | 62/282 |
| 3,507,322 | A * | 4/1970 | Reed et al. | 165/61 |
| 4,026,121 | A | 5/1977 | Aokage et al. | |
| 4,117,698 | A | 10/1978 | Vogel | |
| 4,203,486 | A | 5/1980 | Rubbright et al. | |
| 4,207,747 | A | 6/1980 | Subera et al. | |
| 4,272,966 | A * | 6/1981 | Niemann et al. | 62/180 |
| 4,527,734 | A * | 7/1985 | Swain et al. | 236/49.1 |
| 4,548,049 | A * | 10/1985 | Rajgopal | 62/275 |
| 4,603,491 | A | 8/1986 | Hengle et al. | |
| 4,736,592 | A * | 4/1988 | Ohling | 62/62 |
| 4,936,105 | A | 6/1990 | Takechi et al. | |
| 5,003,867 | A * | 4/1991 | Sodec et al. | 454/236 |
| 5,025,638 | A * | 6/1991 | Yamagishi et al. | 62/180 |
| 5,305,953 | A * | 4/1994 | Rayburn et al. | 236/49.3 |
| 5,369,960 | A | 12/1994 | Mueller et al. | |
| 5,491,979 | A | 2/1996 | Kull et al. | |
| 5,513,500 | A | 5/1996 | Fischer et al. | |
| 5,675,983 | A * | 10/1997 | Ibrahim | 62/255 |
| 5,799,728 | A * | 9/1998 | Blume | 165/231 |
| 5,816,053 | A * | 10/1998 | Huether | 62/65 |
| 5,826,432 | A | 10/1998 | Ledbetter | |
| 5,921,096 | A | 7/1999 | Warren | |
| 5,953,928 | A * | 9/1999 | Saia et al. | 62/239 |
| 6,164,085 | A * | 12/2000 | Clarke et al. | 62/408 |
| 6,286,326 | B1 * | 9/2001 | Kopko | 62/179 |

(Continued)

*Primary Examiner* — Frantz Jules
*Assistant Examiner* — Filip Zec
(74) *Attorney, Agent, or Firm* — Drinker Biddle & Reath LLP

(57) ABSTRACT

A refrigeration apparatus includes an air chiller, a storage enclosure defining a compartment, a duct system, and a valve system. The air chiller blows chilled air into the duct system. The compartment has a first and a second opening, each of which is coupled to the duct system. The valve system has valves that can be moved to route the chilled air so that it enters into the first opening and exits the second opening, or vice versa. In one implementation, the first opening is at the top of the compartment and the second opening is at the bottom of the compartment, and the valve system is controlled by a control circuit that periodically switches the valves (via an actuator) to change the direction of the chilled air. This effectively maintains a relatively uniform temperature throughout the compartment.

23 Claims, 3 Drawing Sheets

U.S. PATENT DOCUMENTS

| | | | | |
|---|---|---|---|---|
| 6,298,912 | B1 * | 10/2001 | Rayburn et al. | 165/249 |
| 6,367,274 | B1 * | 4/2002 | Mellado | 62/256 |
| 6,572,207 | B2 | 6/2003 | Hase et al. | |
| 6,832,504 | B1 | 12/2004 | Birkmann | |
| 6,845,627 | B1 | 1/2005 | Buck | |
| 7,007,501 | B2 * | 3/2006 | Hu | 62/435 |
| 7,024,874 | B2 | 4/2006 | Zywiak et al. | |
| 7,357,000 | B2 * | 4/2008 | Schwichtenberg et al. | 62/255 |
| 2007/0017233 | A1 * | 1/2007 | Hawkins | 62/63 |

* cited by examiner

METHOD AND APPARATUS FOR MAINTAINING A UNIFORM TEMPERATURE IN A REFRIGERATION SYSTEM

TECHNICAL FIELD

This application relates generally to food and beverage refrigeration and more particularly, to food and beverage refrigeration systems that alter airflow to maintain uniform temperatures.

BACKGROUND

Maintaining a relatively uniform temperature is important in any refrigeration system, but it is particularly important in the context of food and beverage refrigeration. Without proper temperature distribution, some food in a refrigerator will be too cold, resulting in unwanted freezing and some will be too warm, which raises the risk of spoilage. In most contexts, a uniform temperature is not only desirable, but is mandated by regulations. For example, depending upon the aircraft operating authority certain types of food served on passenger airlines is required to be maintained at a maximum temperature of no more than 7° C. and in some countries 4° C.

Typically, pre-prepared airline food is stored in galley carts prior to serving to passengers. However, current galley cooling systems have to force air just above freezing either into the galley carts or into insulated compartments containing several galley carts just to ensure that the temperature does not exceed the required temperature in any portion of the carts. This is due to the temperature increase as the air passes through or over the galley carts to remove the heat entering the galley cart or compartment. The lower maximum temperature requirement of 4° C. means that the current cold air source is less efficient resulting in the need to use more powerful and heavier systems that use more electrical power. Thus, it can be seen that there is a need for a new method and apparatus for maintaining a uniform temperature in a refrigeration system.

SUMMARY

In accordance with the foregoing, a method and apparatus for maintaining a uniform temperature in a refrigeration system is provided. According to an embodiment of the invention, the method involves directing chilled air through a galley cart or compartment in a first direction, switching the flow of the chilled air to a second direction (substantially opposite the first direction), and periodically repeating these steps. In another embodiment, the apparatus includes an air chiller, a storage enclosure defining a compartment, a duct system, and a valve system. The air chiller blows chilled air into the duct system. The compartment has a first and a second opening, each of which is coupled to the duct system. The valve system has valves that can be moved to route the chilled air so that it enters into the first opening and exits the second opening, or vice versa. In one embodiment, the first opening is at the top of the compartment and the second opening is at the bottom of the compartment, and the valve system is controlled by a control circuit that periodically switches the valves (via an actuator) to change the direction of the chilled air. This effectively maintains a relatively uniform temperature throughout the compartment.

DETAILED DESCRIPTION

Figure 1:
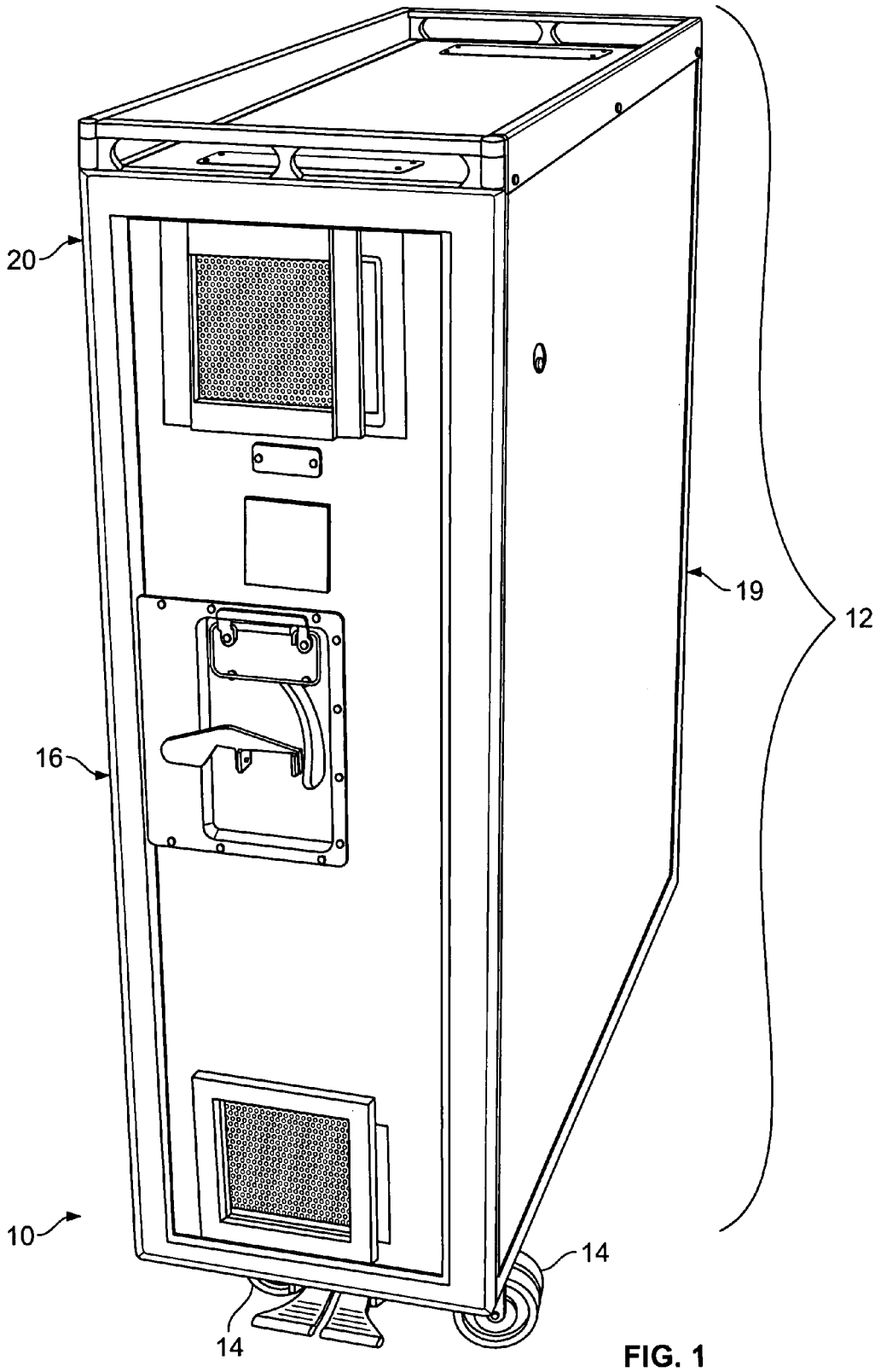
FIG. 1 shows a back perspective view of a galley cart that may be used in conjunction with an embodiment of the invention.
Figure 2:
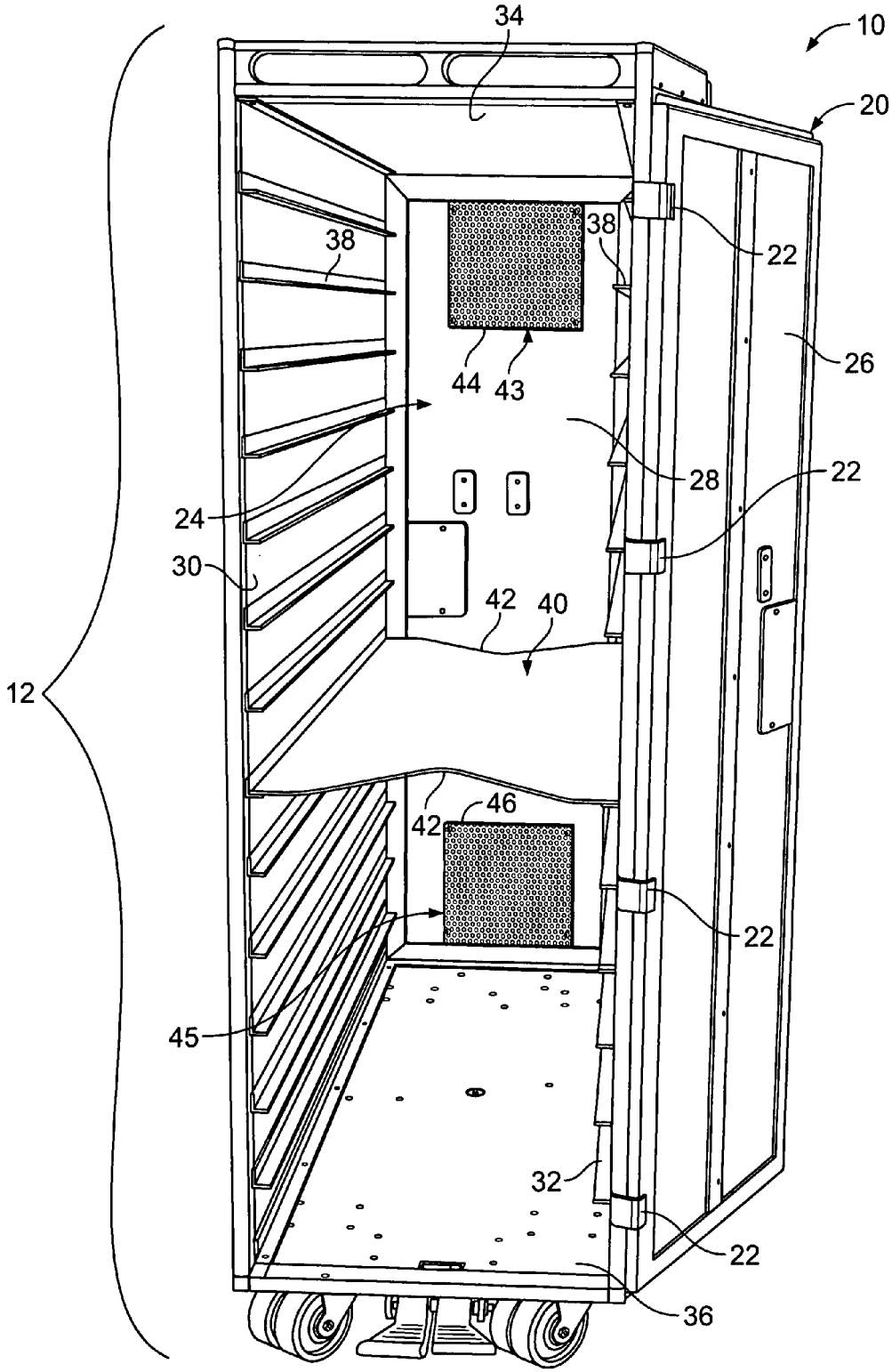
FIG. 2 shows the cart depicted in FIG. 1 with the door open.

Referring to FIGS. 1 and 2, a galley cart that is used in conjunction with an embodiment is shown. The cart, generally labeled 10, includes an enclosure 12 and castors 14 attached to the bottom of the enclosure 12. The enclosure 12 has a front side 16 and a back side 19. A door 20 is attached to the front side 16 by hinges 22. The enclosure 12 has a storage compartment 24 defined by an inner surface 26 of the door 20, a back wall 28, a first side wall 30, a second side wall 32, a ceiling 34, and a floor 36.

Protruding from the first and second side walls 30 and 32, are rails 38, which are configured to hold food trays. The enclosure 12 also has a divider 40 attached to the first and second side walls 30 and 32. The divider 40 is disposed at or about the vertical midway point of the side walls 30 and 32. The divider 40 has a pair of generally V-shaped cutouts 42, one proximate to the door 20 and one proximate to the back wall 28. The back wall 28 has a pair of generally square openings, a first opening 43 and a second opening 45, in which a first grill 44 and a second grill 46 are disposed. The first and second openings 43 and 45 link the storage compartment 24 with the outside of the enclosure 12, allowing air to move in or out through the grills 44 and 46.

The first grill 44 is located proximate to the ceiling 34 while the second grill 46 is located proximate to the floor 36. The first and second grills 44 and 46 permit air to flow through the back wall 28.

Figure 3:
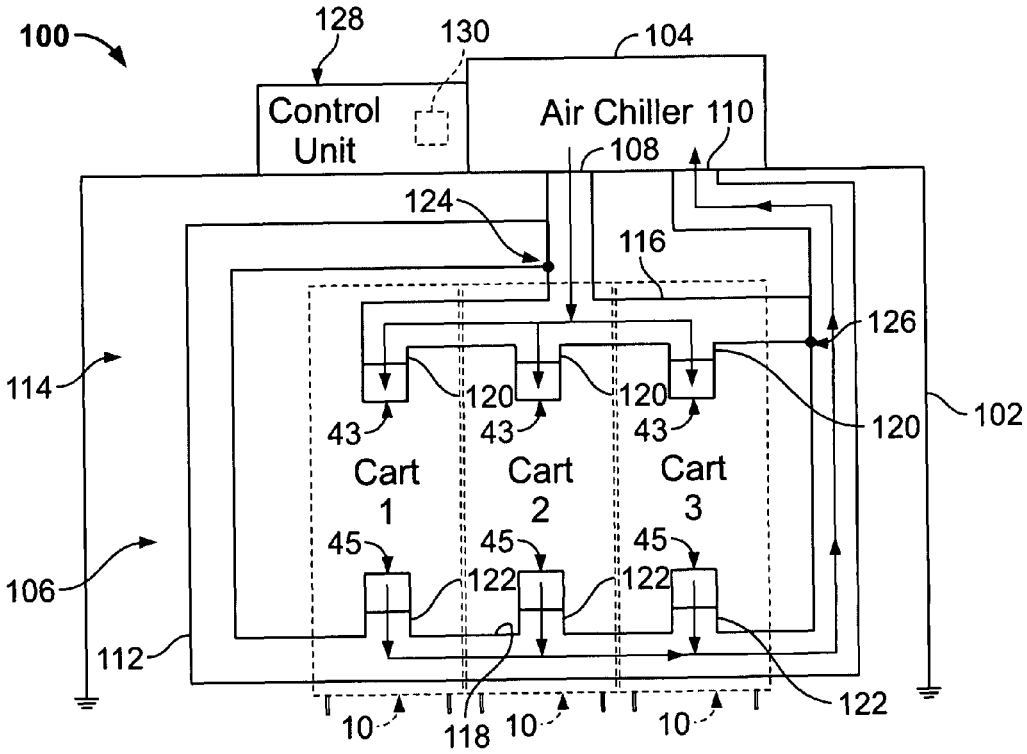
FIG. 3 is a front elevational view of a refrigeration system configured according to an embodiment of the invention, in which the valve system is in a first configuration.

Referring to FIG. 3, an example of a refrigeration system configured according to an embodiment of the invention will now be described. The system, generally labeled 100, includes a cart corral 102, an air chiller 104 disposed on top of the cart corral 102, and a duct system 106 disposed within the cart corral 102. The duct system has an inlet 108 and an outlet 110. The air chiller 104 has an outlet that is coupled to the inlet 108 of the duct system 106. The air chiller 104 also has an inlet that is coupled to the outlet 110 of the duct system 106.

The duct system 106 has a main duct 112 that extends around the inner periphery of the cart corral 102. The main duct 112 starts at the inlet 108 of the duct system 106 and terminates at the outlet 110 of the duct system 106.

The cart corral 102 has an open side 114 that enables a cart to be parked within the corral 102. FIG. 3 shows 3 carts, each of the carts being parked within the corral 102. Cart 10 in this example will be assumed to have the same configuration as the cart 10 of FIG. 1. Each cart 10 is parked so that its front side 16 faces the open side 114 of the cart corral 102.

In addition to the main duct 112, the duct system 106 includes a first branch 116 and a second branch 118. The first branch 116 has openings 120 that are next to or coupled with the first openings 43 of the carts 10. Similarly, the second branch 118 has openings 122 that are next to or coupled with the second openings 45 of the carts 10.

Disposed within the duct system 106 is a valve system, which includes a first valve 124 and a second valve 126. The refrigeration system 100 also includes a control unit 128. The control unit 128 includes a control circuit 130, which controls the movement of the first and second valves 124 and 126 by sending signals to an actuator that is mechanically coupled to the first and second valves 124 and 126. The first valve 124 has at least two positions—a first position, shown in FIG. 3, in which the first valve 124 directs air flowing from the inlet 108 of the duct system 106 to flow to the first branch 116, and a second position, shown in FIG. 4, in which the first valve 124 prevents air flowing from the inlet 108 of the duct system 106 directly to the first branch 116. The second valve 126 also has at least two positions—a first position, shown in FIG. 3, in which the second valve 126 prevents air from flowing from the first branch 116 to the main duct 112, and a second position, shown in FIG. 4, in which the second valve 126 permits air to flow from the first branch 116 to the main duct 112.

The refrigeration system 100 has at least two modes of operation—a normal airflow mode and a reversed airflow mode. The normal airflow mode will now be described with respect to FIG. 3. In the normal airflow mode, the valve system is in a configuration in which the first valve 124 and the second valve 126 are in their respective first positions. The air chiller 104 blows chilled air into the inlet 108 of the duct system 106. Because the first valve 124 prevents airflow directly from the inlet 108 to the main duct 112, the air flows from the inlet 108 to the first branch 116, and then flows through openings 120 of the first branch 116 and through the first openings 43 of the carts 10. The chilled air flows through the storage compartment 24 of each cart 10, through the generally V-shaped cutouts 42, and out the second openings 45 of the carts 10. The chilled air exiting the second openings 45 passes through the second branch 118 and proceeds to the main duct 112 and out the outlet 110.

Figure 4:
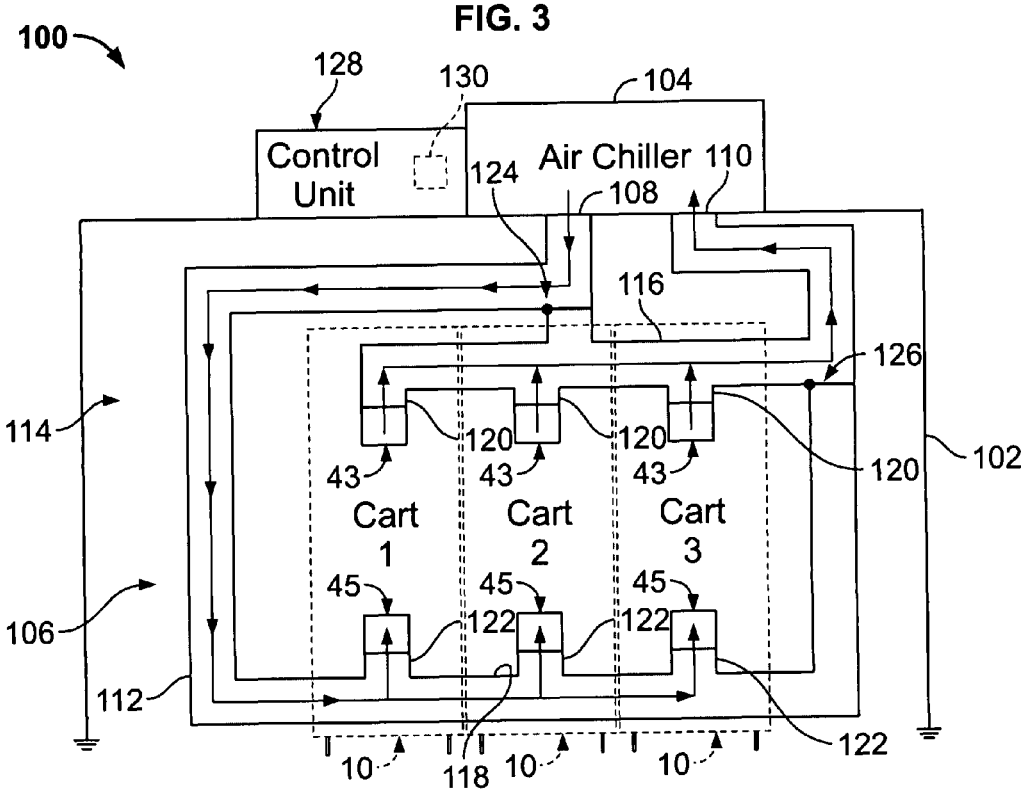
FIG. 4 is a view of the refrigeration system of FIG. 3 in which the valve system is in a second configuration.

The reverse airflow mode will now be described with reference to FIG. 4. In the reverse airflow mode, the valve system is in a configuration in which the first valve 124 and the second valve 126 are in their respective second positions. The first valve 124 in its second position directs airflow from the inlet 108 to the main duct 112. With the second valve 126 in its second position, airflow from the main duct 112 is prevented from flowing directly back to the chiller 104 through the outlet 110. Instead, the air flows from the main duct 112 into the second branch 118, through the openings 122 of the second branch 118, and through the second openings 45 of the carts 10. The chilled air then passes through the storage compartment 24 of each cart 10, through the generally V-shaped cutouts 42, and out the first openings 43 of the carts 10. The chilled air exiting the first openings 43 passes through first branch 116 and proceeds to the main duct 112 and back to the chiller 104 through the outlet 110.

According to an embodiment of the invention, the refrigeration system periodically switches from the normal airflow mode to the reverse airflow mode. The time interval for switching the airflow can depend on many factors, such as the desired temperature of the system, and may also depend upon a sensed temperature of the system. This could include, for example, temperature sensors that determine whether there is a difference between the temperature at the top of a cart as compared to the temperature at the bottom of a cart. If such a difference exceeds a particular threshold, the airflow may be switched to provide more uniform cooling. In one implementation, the switching may occur periodically from 2 to 30 minutes. The switching between the normal mode and the reverse mode is controlled by the control circuit 130 of the control unit 128. Periodically reversing the flow of air helps to equalize the temperature throughout the compartment 24.

As should be appreciate by one of skill in the art, the foregoing describes an embodiment where 3 different carts are accommodated within the cooling system of the present invention. The same invention may be readily implemented with respect to more or less carts. For example, the invention may be implemented with respect to just one cart, where 2 valve are operated to direct airflow through the cart initially in one direction, then to direct airflow through the cart in the other direction.

It can be seen from the foregoing that a new and useful method and system for identifying and managing currency exposure has been described. The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

I claim:

1. A method for cooling a plurality of food or beverage compartments, the method comprising:

(a) directing chilled air through each of the compartments in a first direction via a ducting system having ducting in common with all of the compartments, each of the compartments comprising a rectangular volume entirely bounded on six sides, wherein each of the compartments has two openings that correspond one-to-one with individual openings in the ducting system;

(b) after step (a), inhibiting the flow of the chilled air from flowing in the first direction;

(c) after step (b), directing chilled air through the compartment in a second direction that is substantially opposite the first direction;

(d) after step (c), inhibiting the flow of the chilled air from flowing in the second direction; and (e) after step (d), repeating step (a);

wherein reversing the flow of the chilled air between the first direction and the second direction is achieved exclusively by operation of a valve system comprising a first valve and a second valve, each having a first position permitting air to flow in the first direction, and a second position allowing the air to flow in the second direction.

2. The method of claim 1, further comprising waiting for a predetermined interval of time after step (a) before performing step (b).

3. The method of claim 1, wherein the first direction is from the top of the compartment to the bottom of the compartment and the second direction is from the bottom of the compartment to the top of the compartment.

4. The method of claim 1, wherein step (a) comprises blocking the flow of the chilled air through a first path of a duct system and unblocking the flow of the chilled air down a second path of the duct system.

5. The method of claim 1, wherein step (a) comprises directing the chilled air into a first opening of the compartment and out of a second opening of the compartment and wherein step (c) comprises directing the chilled air into the second opening of the compartment and out of the first opening of the compartment.

6. The method of claim 5, wherein step (a) comprises blocking a portion of a duct system to prevent the chilled air from escaping through the first opening, and step (d) comprises blocking another portion of the duct system to prevent the chilled air from entering through the first opening.

7. The method of claim 1, wherein step (a) comprises chilling air to create the chilled air, blowing the chilled air through a first opening of a duct system that is connected to the compartment, and moving a set of valves in the duct system to a first position, wherein step (c) comprises chilling air to create the chilled air, blowing the chilled air into the first opening, and moving the set of valves to a second position.

8. An apparatus for cooling food or beverages, the apparatus comprising:

an air chiller;

a plurality of storage enclosures, each enclosure defining a compartment, each said storage enclosure having a first opening and a second opening, which permits air to pass between the compartment and the outside of the enclosure;

a duct system coupled to the air chiller and to the first and second openings, wherein the duct system has some portion of ducting in common with each of the plurality of storage enclosures, and has individual openings that correspond one-to-one with the first and second openings of each of the enclosures;

a valve system comprising a first valve and a second valve, each having a first position permitting air to flow from the air chiller into the first opening and through a central part of the compartment, and a second position inhibiting air from entering into the first opening but permits air to escape from the first opening, wherein flow of air through the duct system is reversed exclusively by the first and second valves.

9. The apparatus of claim 8, further comprising a divider disposed within the compartment wherein the divider divides the compartment into an upper portion and a lower portion, the divider having a cutout that permits cool air to flow between the upper and lower portions.

10. The apparatus of claim 8, wherein the storage enclosure has a top and a bottom, the first opening being located proximate to the top and the second opening being located proximate to the bottom.

11. The apparatus of claim 8, wherein the duct system comprises a branch coupled to the first opening, wherein the valve blocks the branch when the valve is in the second position.

12. The apparatus of claim 11, wherein said branch is a first branch, the duct system further comprising a second branch coupled to the second opening and a main duct coupled to the air chiller, the first branch, and the second branch.

13. The apparatus of claim 8, further comprising a control circuit that periodically initiates movement of the valve from the first position to the second position.

14. The apparatus of claim 8, wherein said valve is a first valve, the valve system further comprises a second valve, the apparatus further comprising a control circuit that transmits a signal to move the first valve from the first position to the second position and to move the second valve from a first position, in which it inhibits air from exiting the first opening to a second position in which it permits air from exiting the first opening.

15. The apparatus of claim 8, wherein the storage enclosure is a rectangular volume entirely bounded on six sides.

16. The apparatus of claim 8, wherein the first opening and the second opening are in one side of the storage enclosure.

17. The apparatus of claim 8, wherein the valve is located in the common portion of the ducting.

18. The apparatus of claim 17, wherein the valve allows airflow in a first part of the common portion of the ducting when it is in the first position, and blocks airflow in the first part of the common portion of the ducting when it is in the second position.

19. A system for cooling food or beverages, the system comprising:

a cart corral comprising an enclosure;

a cooling unit that generates chilled air;

a duct system that transports the chilled air;

a valve system comprising a first valve and a second valve, each having a first configuration and a second configuration;

a plurality of carts disposed at least partially within the enclosure, each cart of the plurality comprising a compartment, the compartment comprising a rectangular volume entirely bounded on six sides, and having a first opening that connects the compartment to an individual opening in the duct system and a second opening that connects the compartment to a separate opening in the duct system;

wherein the duct system comprises ducting in common with all of the compartments;

wherein, when the valve system is in the first configuration, the chilled air is routed into the first opening of each of the plurality of carts, through the compartment in a first direction and out of the second opening of each of the plurality of carts, and when the valve system is in the second configuration, the chilled air is routed into the second opening of each of the plurality of carts, through the compartment in a second direction and out of the first opening of each of the plurality of carts, reversing the flow of the air in the first direction to the second direction being performed exclusively by the first valve and the second valve.

20. The system of claim 19, further comprising a control circuit that controls the interval of time between which the value system is in the first configuration and in which the valve system is in the second configuration.

21. The system of claim 20, wherein the interval of time is about 2 to 30 minutes.

22. The system of claim 21, wherein the chilled air generated by the air chiller is at a temperature of about between 0 and 7 degrees C.

23. The system of claim 19, wherein the first opening is proximate to the top of each cart and the second opening is proximate to the bottom on each cart.

* * * * *